United States Patent [19]

Wyss

[11] Patent Number: 5,056,404

[45] Date of Patent: Oct. 15, 1991

[54] INSTANT GUITAR TUNING BY EAR

[76] Inventor: John R. Wyss, 4020 - 148th Ave. NE. Suite F, Redmond, Wash. 98052

[21] Appl. No.: 507,648

[22] Filed: Apr. 11, 1990

[51] Int. Cl.[5] ..... G10H 1/04; G10H 3/26; G10H 3/18; G10H 3/12

[52] U.S. Cl. ..... 84/725; 84/455; 84/735; 84/743

[58] Field of Search ..... 84/725–728, 84/DIG. 18, 454, 455, 458, 735, 743

[56] References Cited

U.S. PATENT DOCUMENTS

| | | | |
|---|---|---|---|
| 4,143,575 | 3/1979 | Oliver | 84/726 |
| 4,181,058 | 1/1980 | Suenaga | 84/726 |
| 4,472,994 | 9/1984 | Armstrong | 84/726 |

*Primary Examiner*—William M. Shoop, Jr.

*Assistant Examiner*—Brian Sircus

[57] ABSTRACT

In a stringed instrument which generates sound reproduction output signals by way of a transducer which are amplified for sound reproduction, a fundamentally correct note frequency signal is generated and electromagnetically broadcast by cycles of electromagnetic energy directly from a metallic string to be tuned to the transducer of the instrument, and blends with a correlated note as it issues from the same said vibrating metal string to be tuned, and through discernment by the ear of the user of the resulting blended signal the string is adjusted as necessary to match the two notes and therefore the string is quickly and easily brought into tune with the fundamentally correct note frequency, and when repeated upon each string of said instrument the task of tuning is done.

1 Claim, 1 Drawing Sheet

INSTANT GUITAR TUNING BY EAR

BACKGROUND OF THE INVENTION

In the field of tuning devices for musical instruments and specifically the field of tuning devices used to discern correct fundamental pitch in electric guitar strings and other stringed instruments which utilize transducers to translate metallic string vibration into electromagnetic signals, and when amplified reproduce sound, a new tuning concept is herein disclosed.

Prior art in tuning devices in essence makes a comparison of two separate signals through visible or audible means. One is generated by a tuning device, and is assumed to be fundamentally correct in frequency. This tone is generated by electronic oscillations, a tuning fork mechanism, a crystal, or a like means. The means are well known and described in prior art extensively.

A second signal issues forth from the action of the vibration of the string to be tuned. Prior art gives intricate electronic or stroboscopic means with which to make comparison, or automatically compares and indicates to the user a needed correction in the tautness of the string, by presence of harmonic resonant distortion thus indicating incorrectness of the frequency of vibration issuing from said string. In itself this distortion, or error signal, is a well known effect.

Examples are Osborn, Etal, U.S. Pat. No. 3,501,992, which allows the user to compare two separate audible tones by ear, and Pagoda, U.S. Pat. No. 4,252,048, which compares two such signals stroboscopically. Other methods all offer means of comparing two separate frequencies, one being fundamentally correct, and one issuing from a string of the instrument which is to be tuned. Extensive skill by the user or complex electronics are involved, and both consume time and effort to set up the system for use.

SUMMARY OF THE INVENTION

My art shows a method which instantaneously blends the said two separate signals into one combined signal which issues forth from the string itself. Clarity is thereby greatly enhanced, which aids the user in critical discernment necessary to tune the instrument.

It is an object to provide a tuning system which when in use with a typical electric guitar or other stringed instrument which utilizes transducer means for sound reproduction affords greater clarity and definition of audible tones for tuning by ear which a user will find enhances critical discernment and therefore makes the task of tuning the instrument by ear much easier. It is a further object to accomplish such additional clarity and definition by the blending of a fundamentally correct note frequency with that which issues from a correlated metallic string to be tuned such that both notes issue from the same string simultaneously and thereby blend as they are received be the transducer of the sound reproduction system of the instrument, and upon such blending, amplification of the resultant tone such that audible discernment, especially of a resonant harmonic error signal by way of added emphasis thereon. This is by vibration of the broadcast energy transmission itself. Thereby proper tuning adjustment by the user can be effected upon the said string being tuned.

It is therefore an object to use electromagnetic broadcasting means to transmit the said fundamentally correct frequency through the string to be tuned such that this broadcast frequency and the vibration frequency which issues from the vibrating metal string to be tunec are received substantially simultaneously at the transducer, and thereby converted to a single usable energy signal to thence be audibly reproduced by amplification.

It is an advantage that through said blending of frequencies issuing from a metallic string to be tuned tha upon amplification of said transducer output increasec audible definition and clarity of the resultant audible display makes the difficult task of accurately tuning by ear simple and easy for even beginning musicians or the average in skill.

Furthermore, the above is accomplished with a minimum of setup or delay and is very inexpensive, yet highly effective. The active apparatus can be matchbook size, is portable and easily attached to existing typical electric guitars and stringed electric instruments.

DETAILED DESCRIPTION OF THE INVENTION

Figure 1:
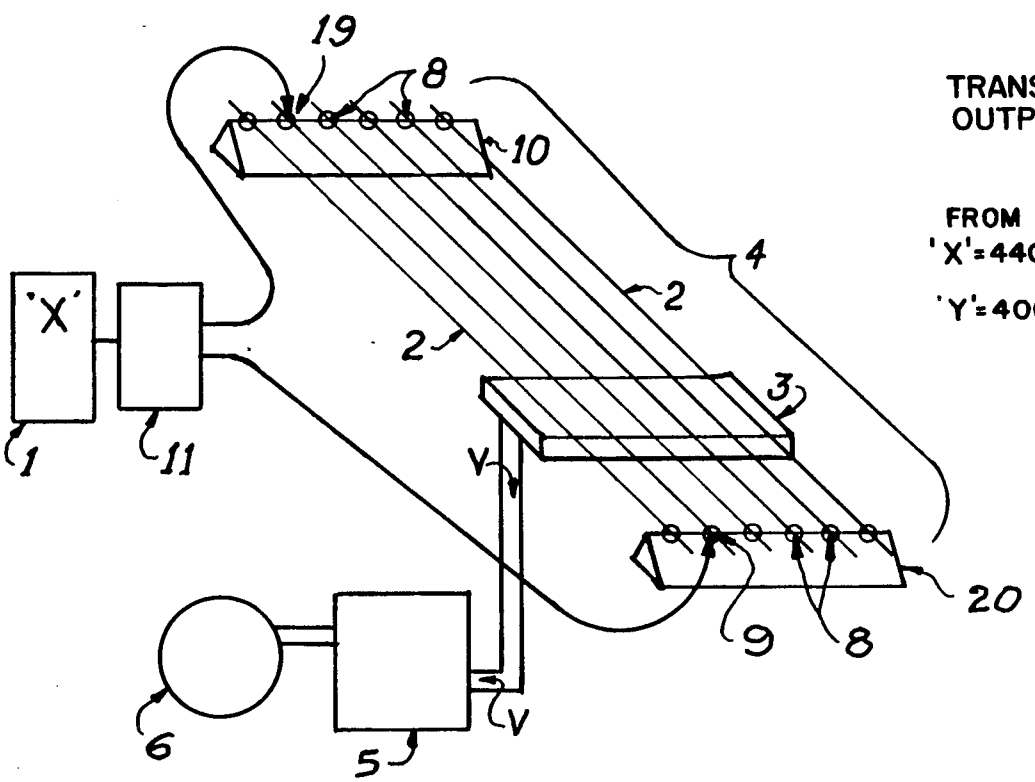
FIG. 1 — Apparatus for tuning by ear.

Turn now to FIG. 1, showing operation of a preferred embodiment. A typical oscillator, 1, and transmitter, 11, emits a standard fundamental tone frequency 'x' which is broadcast in a known fashion electromagnetically as cycles per second of broadcast energy. The energy, +, will be transmitted directly through a correlated metallic string, 2, suspended at points '8' in a known fashion between 10 and 20 together with a known means of increasing or decreasing tension (not shown) of said string, 2, for tuning purposes, said frequency 'x' is thereby reproduced in the transducer, 3, of the instrument, 4, which is broadly interpreted as being the housing assembly of the strings and bridges, and a transducer, the resultant output signal 'V' is amplified at an amplifier, 5, and made audible at loudspeaker, 6, as a standard fundamental note tone.

Figure 2:
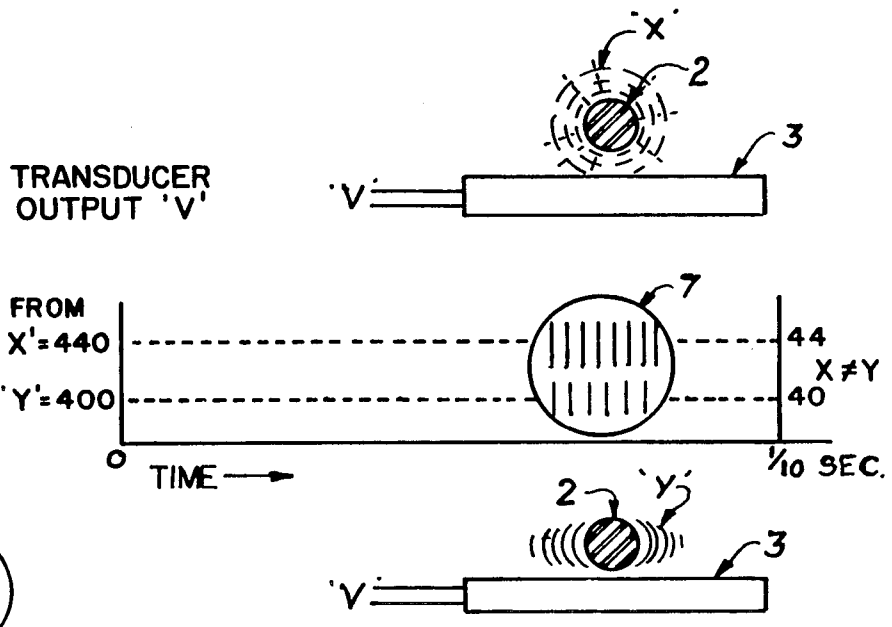
FIG. 2 — X and Y signals translated to transducer output.

Turn now your attention to FIG. 2, which shows the separate actions of the string relating to broadcast frequency 'x' and vibration frequency 'y' and note that coinciding with the said broadcast is the user's plucking or vibrating of said correlated string to be tuned, causing the string to issue forth its natural frequency intonation 'y' from the rate of vibration thereof, which when properly tuned equals said standard fundamental frequency 'x'. The 'y' frequency is also received by the transducer and audibly reproduced as a tone, being the true sound reproduction of said string. 'Y' refers to the natural vibrations per second of the taut string of the instrument. Therefore as both 'x' and 'y' frequencies are simultaneously received by the transducer and the resultant output 'V' as a blended output signal are amplified, 'x'+'y' becomes audible with the effect of added emphasis on any present error signal or conflicting resonance of tone, a result of broadcasting through the string and thereby reinforcing 'x' waves with vibrations 'y' as they are emitted together outward from said string.

When 'x'='y' the instrument has been tuned in accordance with the fundamentally correct standard frequency. If 'x' is not equal to 'y' a very discernible audible rhythmic error signal is automatically produced by the effects of conflicting resonance. This phenomenon has been oft noted in prior art and is well established, and is especially pronounced in this embodiment due to the addition of 'y' vibrations to the broadcast energy transmission of the 'x' frequency.

For example, in electric guitars, an 'A' string is typically considered the '5th' string. The 'A' note as a fundamentally correct standard frequency as it correlates to the 'A' string is 440 vibrations or cycles per second. Therefore, to begin tuning the 'A' string select a broadcast frequency such that x=440 c.p.s., and if the string issues such that y=440 c.p.s. then the string is tuned.

If 'y' is not equal to 'x', for example, if 'y'=400 c.p.s., or any other than the correct frequency, an audible rhythmic error signal is caused by conflicting resonance, by the uneven matching of 'x'+'y' input energy signals within the circle, 7, of the Transducer Output graph, which manifests as harmonic beats when audibly reproduced as a result of interference with the fundamentally correct frequency. In a tuned string 'y' must equal 'x'. In this example, adjustment is required to increase string tension which will then quickly bring the string into tune at 'y'=440 c.p.s., therefore 'y'='x', and the string has been properly tuned.

The method is repeated with each string to be tuned, said 'x' tone being the fundamentally correct pitch with regards to a correlating string to be tuned on an instrument. Frequency 'x' is broadcast by a loop circuit such as is demonstrated in the example of FIG. 1, said transmission energy is easily connected to opposite ends of the string to be tuned, 2, by 9 and 19 or any such broadcasting antenna means, however especially, as illustrated here, means including said string to be tuned such that 'x' and 'y' are simultaneously reproduced audibly by amplification of resultant output signals of an electromagnetic transducer within the effective proximity of said string.

In a typical electric guitar, the selected 'x' tone frequency to be generated by the oscillator and broadcast by the transmitter would correlate to the strings commonly known as Low E, A, D, G, B, and High E, which in turn are also referred to as 6th, 5th, 4th, 3rd, 2nd, and 1st strings.

Since variations of this tuning for guitars occur, and this invention is adaptable to all stringed instruments which utilize a transducer to reproduce audible tones through amplification of electromagnetic signals, the embodiment described herein is meant to be an example of a preferred application, yet not to be construed as limiting the application of this tone blending method.

By broadcasting from the string being tuned, additional clarity of audible tones, especially of resonance due to reinforcement of a rhythmic error signal, a distinct advantage of this novel method, is achieved. Emphasis is made in definition of present rhythmic error signals by virtue of vibrating the string as it broadcasts a fundamentally correct frequency, reinforcing the 'x' transmission integrally with 'y' vibration, highlighting harmonic resonance, readily indicating that incorrectness is present, thereby assisting the user in the critical discernment necessary to tune stringed instruments by ear.

Thus having described the operation of the invention, I claim:

1. An electronic stringed instrument comprising:

at least one string which is vibrated, a transducer for converting the electromagnetic energy produced by vibrations of said string into representative electrical signals, amplifying means to amplify the electrical signals and reproducing means to convert the amplified electrical signals into audible sounds;

in combination with an apparatus for tuning strings of an electronic stringed instrument comprising:

an oscillator for generating a fundamentally correct tone signal which corresponds to a desired tone of a string to be tuned, transmissions means for transmitting the correct tone signal of the oscillator as cycles of electromagnetic energy, connection means for connecting the cycles of electromagnetic energy to one of the strings which is to be tuned, whereby the transducer means of the stringed instrument converts both the electromagnetic energy produced by the vibration of the strings and the electromagnetic energy from the transmission means into a blended electric signal which is then amplified and reproduced so that a difference in the frequency of these signals will be audible to a user who may then correct the tuning.

* * * * *